United States Patent [19]

Itoh et al.

[11] 4,386,297

[45] May 31, 1983

[54] GAS DISCHARGE PANEL DEVICE

[75] Inventors: Masanori Itoh, Suzaka; Minoru Tanaka, Obusemachi, both of Japan

[73] Assignee: Fujitsu Limited, Kawasaki, Japan

[21] Appl. No.: 213,409

[22] Filed: Dec. 5, 1980

[30] Foreign Application Priority Data

Dec. 11, 1979 [JP] Japan ..... 54-159727

[51] Int. Cl.[3] ..... H05B 41/00

[52] U.S. Cl. ..... 315/169.4; 340/777; 340/789

[58] Field of Search ..... 315/169.4; 340/758, 340/776, 777, 789

[56] References Cited

U.S. PATENT DOCUMENTS 4,099,097 7/1978 Schermerhorn et al. ... 315/169.4 X 4,100,461 7/1978 Hada et al. ..... 315/169.4

4,280,079 7/1981 Nishida ..... 340/789 X

*Primary Examiner*—Eugene R. LaRoche

*Attorney, Agent, or Firm*—Staas & Halsey

[57] ABSTRACT

Disclosed is a driving circuit of a gas discharge panel comprising X-electrode rows and Y-electrode columns arranged in a matrix. In order to decrease the number of driving elements, the X-electrode driver is comprised of a first up drive circuit commonly used for applying a discharge sustaining voltage and a write-in voltage to the X electrodes, and a first down drive circuit for grounding the first up drive circuit when the discharge sustaining voltage or the write-in voltage is not applied to the X electrodes. Also, the Y-electrode driver is comprised of a second up drive circuit for applying a discharge sustaining voltage to the Y electrodes, a second down drive circuit for grounding the second up drive circuit when the discharge sustaining voltage is not applied to the Y electrodes, a write-in driver for applying a write-in voltage to the Y electrodes, and a clamping circuit for grounding the Y electrodes when the write-in voltage is not applied to the Y electrodes.

29 Claims, 5 Drawing Figures

X
XU1~XU5
XD1~XD3
Y
YU1, YU2
YD1, YD2
YW1~YW7
YC1, 2
YK(Y18, Y28)
YKW
Ⓢ
Ⓦ
Ⓔ
Ⓒ
48μS
12μS
3μS
96μS
t1
t2
t3
t4
t5
t6
t7
t8
t9

GAS DISCHARGE PANEL DEVICE

BACKGROUND OF THE INVENTION

The present invention relates to a gas discharge panel device, and more particularly to a low cost and improved driving circuit for controlling the display of an AC memory type plasma display panel device (herein referred to a PDP).

In general, an AC memory type PDP is constructed by a group of fine thread X electrode lines and a group of fine thread Y electrode lines. These X electrode lines and Y electrode lines are arranged in a matrix. Each group is covered by a dielectric layer such as glass. These two dielectric layers are arranged so that the X-electrode group and Y-electrode group are extended orthogonally to each other. The gas between these two dielectric layers is filled with, for example, neon gas. A driving circuit is used to control the display of the AC memory type PDP. It has been known that the driving circuit is required to produce a sustaining voltage for holding a discharge, a write-in voltage and an erasing voltage.

DESCRIPTION OF THE PRIOR ART

As a prior-art driving system, the Japanese Patent Application No. 53-29030, entitled "A driving circuit for gas discharge panel and the method of operation of same" was filed by the same assignee as the subject application. This prior-art driving circuit is comprised of a driver for X electrode lines and a driver for Y electrode lines.

The driver for X electrode lines is comprised of X-electrode up drivers, X-electrode write-in up drivers, X-electrode down drivers, and clamping transistors. The X-electrode up drivers are commonly used for applying a discharge sustaining voltage and for applying an erasing voltage to the X electrode lines. Each of the X-electrode up drivers corresponds to one of the X electrode lines. Each X-electrode write-in up driver is used for applying a write-in voltage commonly to a predetermined number of X electrode lines corresponding to one row. For example, when one character is displayed by 5×7 dots, five X electrode lines correspond to one row. Each X-electrode down driver corresponds to one X electrode line. The X-electrode down drivers are used for grounding the X-electrode up drivers or the X-electrode write-in up drivers, when the discharge sustaining voltage, the erasing voltage or the write-in voltage is not applied. Each of the clamping transistors corresponds to one X electrode line. The clamping transistors are used for absorbing voltages induced at the X electrode lines in response to variation of the voltage applied to the Y electrode lines.

The driver for Y electrode lines is also comprised of one Y-electrode up driver corresponding to each Y electrode line, one Y-electrode write-in up driver corresponding to a predetermined number of Y electrode lines in each column, one Y-electrode down driver corresponding to each Y electrode line, and one clamping transistor corresponding to each Y electrode line for preventing non-selected electrodes from becoming a negative voltage during writing. The predetermined number of the Y electrode lines in one column is, for example, seven, when one character is displayed by 5×7 dots.

According to the prior-art example mentioned above, in the driver for the X electrode lines, the X-electrode up drivers commonly used for applying the discharge sustaining voltage and for applying the erasing voltage, are not commonly used as the X-electroe write-in up drivers. Also, one X-electrode up driver and one X-electrode down driver are provided to each electrode line. Therefore, the number of the driving elements in the driver for X electrode lines is very large. Similarly, in the driver for Y electrode lines, the number of the driving elements is also very large. Also, the number of the clamping transistors is the same as the number of the Y electrode lines. Thus, there is a disadvantage in the prior-art driving circuit that the cost of the driving circuit is much more increased along with an increase in the number of electrode lines.

Another example is also known in the prior art, in which, in order to decrease the number of driving elements, only one up driver for providing a discharge sustaining voltage is provided to correspond to each set of all of the X electrode lines or all of the Y electrode lines. However, according to this second prior-art example, the erasing of one character is impossible.

SUMMARY OF THE INVENTION

Accordingly, it is an object of the present invention to provide a gas discharge panel unit in which the cost of the driving circuit is greatly decreased.

Another object of the present invention is to provide a gas discharge panel unit in which the number of driving elements in the driving circuit is greatly decreased.

Still another object of the present invention is to provide a gas discharge panel unit in which an up drive circuit is commonly used for applying a discharge sustaining voltage and for applying a write in voltage, in a circuit for driving X electrode lines.

Still another object of the present invention is to provide a gas discharge panel unit in which the number of driving elements in the up drive circuit is greatly decreased.

Still another object of the present invention is to provide a gas discharge panel unit in which the number of write-in drivers in a Y-electrode driving circuit is the same as the number of Y electrode lines included in each column.

Still another object of the present invention is to provide a gas discharge panel unit in which the number of write-in drivers is the same as the number of Y electrode lines which correspond to one column, in a circuit for driving Y electrode lines.

Still a further object of the present invention is to provide a gas discharge panel unit in which a single up driver for applying a discharge sustaining voltage is provided to correspond to each column, in the circuit for driving Y electrode lines.

Still further object of the present invention is to provide a gas discharge panel unit in which the number of driving elements in the circuit for driving Y electrode lines is greatly decreased.

Still further object of the present invention is to provide a gas discharge panel unit in which no clamping circuit is required in the circuit for driving X electrode lines, by applying a discharge sustaining voltage to the X electrode lines when a discharge sustaining voltage is not applied to the Y electrode lines.

According to the present invention, there is provided a gas discharge panel device including a gas discharge panel provided with a plurality of rows of X electrode lines and a plurality of columns of Y electrode lines, the rows and columns being arranged in a matrix, and a driving circuit comprised of an X-electrode driver and a Y-electrode driver for controlling the display by applying a discharge sustaining voltage or a write-in voltage to the X electrode lines or Y electrode lines. The X-electrode driver is comprised of a first up drive circuit commonly used for applying the discharge sustaining voltage and the write-in voltage to the X electrode lines, and a first down driver circuit for grounding the first up drive circuit. The Y-electrode driver is comprised of a second up drive circuit for applying the discharge sustaining voltage to the Y electrode lines; a second up drive circuit when the discharge sustaining voltage is not applied to the Y-electrode lines, a write-in driver for applying the write-in voltage to the Y electrode lines, and a clamping circuit for grounding the Y electrode lines when the write-in voltage is not applied to the Y electrode lines.

BRIEF DESCRIPTION OF THE DRAWINGS

The foregoing objects and other objects as well as the characteristic features of the inventin will become more apparent and more readily understandable by the following description when read in conjunction with the accompanying drawings, in which.

DETAILED DESCRIPTION OF THE PREFERRED EMBODIMENTS

Figure 1:
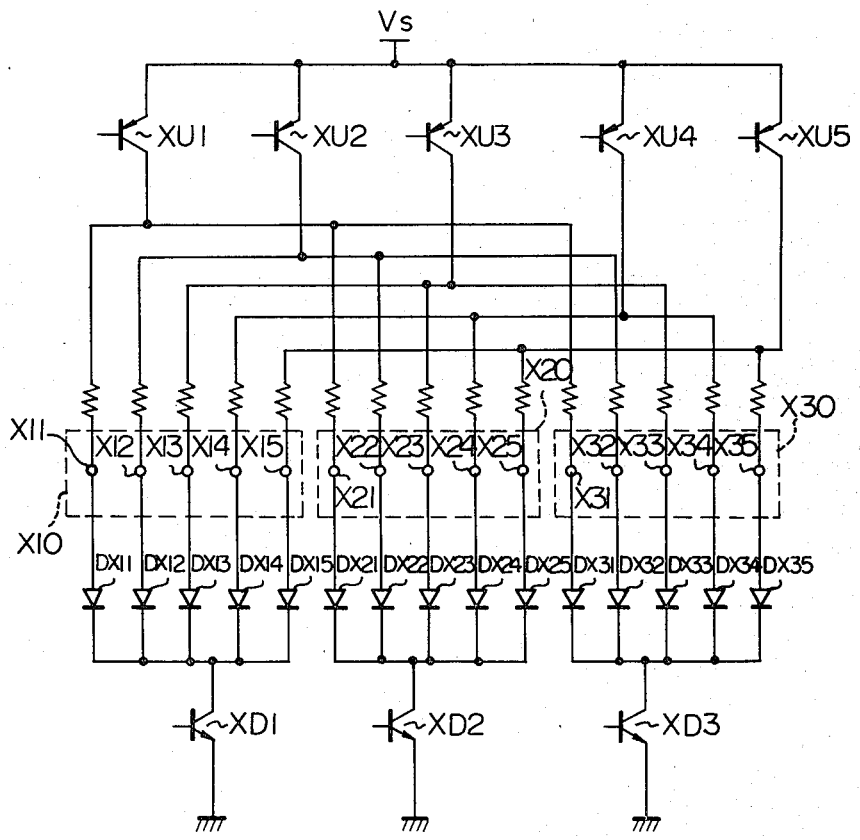
FIG. 1 is a circuit diagram illustrating a main portion of an X-electrode driver in a driving circuit, according to one embodiment of the present invention.

Now, referring to FIG. 1, a circuit diagram of an X-electrode driving circuit according to an embodiment of the invention is illustrated. In FIG. 1, five PNP transistors XU1, XU2, . . . , XU5 act as switching elements in an up drive circuit for providing a discharge sustaining voltage, a write-in voltage and an erasing voltage. The emitters of the transistors XU1, XU2, . . . , and XU5 are connected together to a power supply Vs. The collector of the transistor XU1 is connected to the electrode lines X11, X21 and X31 through resistors, respectively. The electrode line X11 is the first electrode line in the first electrode row X10. The electrode line X21 is the first electrode line in the second electrode row X20. The electrode line X31 is the first electrode line in the third electrode row X30. In a similar way, the collector of the transistor XU2 is connected through resistors to the second electrode lines X12, X22 and X32 in the rows X10, X20 and X30, respectively. The collectors of the transistors XU3, XU4 and XU5 are also connected through resistors to corresponding electrode lines in rows X10, X20 and X30, respectively. The electrode lines X11, X12, . . . , X15 in the first row X10 are connected through forwardly connected diodes DX11, DX12, . . . , DX15, respectively, to the collector of an NPN transistor XD1 which acts as a down drive switching element for the electrode row X10. The electrode lines X21, X22, . . . , X25 in the second row X20 are connected through forwardly connected diodes DX21, DX22, . . . , DX25, respectively, to the collector of an NPN transistor XD2 which acts as a down drive switching element for the electrode row X20. Also, the electrode lines X31, X32, . . . , X35 in the third rox X30 are connected through forwardly connected diodes DX31, DX32, . . . , DX35 respectively, to the collector of an NPN transistor XD3 which acts as a down drive switching element for the electrode rox X30. The emitters of the transistors XD1, XD2 and XD3 are grounded. The diodes DX11 through DX15, DX21 through DX25 and DX31 through DX35 function to prevent the current from flowing reversely. Switching pulses are to be applied to the bases of the transistors XU1, XU2, . . . , XU5 and the transistors XD1, XD2 and XD3, in a manner as hereinafter described, for producing a discharge sustaining voltage, a write-in voltage and an erasing voltage.

In the construction described above, when each row includes five lines, the number of up driving transistors required in the circuit for driving X electrode lines is only five which is independent of the number of rows in the X-electrode driving circuit. Also, only one down driving transistor is required for each row. Further, no clamping transistor is required. Thus, the number of driving elements in the X-electrode driving circuit is greatly decreased in comparison with that of the prior art.

Figure 2:
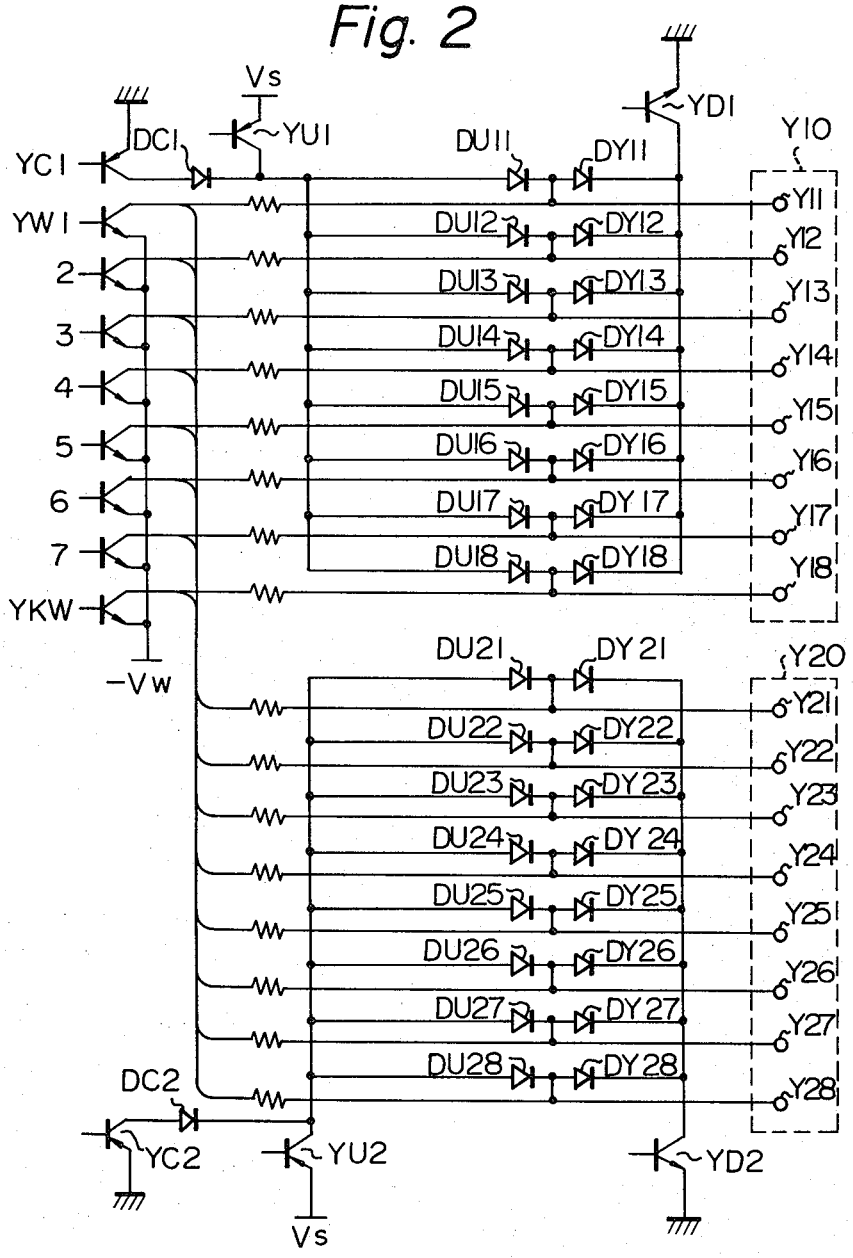
FIG. 2 is a circuit diagram illustrating a main portion of a Y-electrode driver in the driving circuit, according to one embodiment of the present invention.

Referring to FIG. 2, a circuit diagram of a Y-electrode driving circuit is illustrated. In FIG. 2, eight NPN transistors YW1, YW2, . . . , YW7 and YKW are switching elements in a write-in driving circuit. The emitters of these transistors are connected togethe to a write-in power supply-vw. The collector of the transistor YW1 is connected to the first electrode liine Y11 in the first column Y10 and to the first electrode line Y21 in the second column Y20, through resistors, respectively. Also, the collectors of the transistors YW2 through YW7 and YKW are connected to the corresponding electrode lines in the first column Y10 and the second column Y20, through resistors, respectively. The electrode line Y11 in the first column Y10 is connected through a forwardly connected diode DY1 to the collector of an NPN transistor YD1 which functions as a down driving switching element. Also, the other electrode lines Y12, Y13, . . . , Y18 in the first column Y10 are connected, through diodes DY12, DY13, . . . , DY18, respectively, to the collector of the transistors YD1. The electrode lines Y21, Y22, . . . , Y28 in the second column Y20 are also conncted, through diodes DY21, DY22, . . . , DY28, respectively, to the collector of an NPN transistor YD2 which functions as a down driving switching element. PNP transistors YU1 and YU2 are provided to correspond to the first column Y10 and the second column Y20, respectively. The collector of the transistor YU1 is connected, through forwardly connected diodes DU11, DU12, . . . , DU18, to the electrode lines Y11, Y12, . . . , Y18, respectively. The collector of the transistor YU2 is also connected, through diodes DU21, DU22, . . . , DU28, to the electrode lines Y21, Y22, . . . , Y28, respectively. The emitters of the PNP transistors YU1 and YU2 are connected to the power supply vs. The PNP transistors YU1 and YU2 function as up driving switching elements for providing discharge sustaining voltages. Further, PNP transistors YC1 aND YC2 are provided to correspond to the first column Y10 and the second column Y20, respectively. The transistors YC1 and YC2 function as clamping transistors for absorbing negative voltages induced at the Y electrode lines when the voltages applied to the X electrode lines vary from Vs to zero volts. The collector of the transistor YC1 is connected through a forwardly connected diode DC1 to the collector of the transistor YU1 for providing a clamped voltage. Also, the collector of the transistor YC2 is connected through a diode DC2 to the collector of the transistor YU2. Switching pulses are also to be applied to the bases of the transistors YD1, YD2, YU1, YU2, YC1 and YC2, in a manner as hereinafter described, for producing a discharge sustaining voltage, a write-in voltage and an erasing voltage.

By this construction described above with reference to FIG. 2, when each column includes seven lines and one electrode line for indicating a cursor, the number of up driving transistors required in the circuit for driving the Y electrode lines for writing is only eight which is independent of the number of columns in the Y-electrode driving circuit. Also, only one transistor for producing a discharge sustaining voltage is required in each column. Further, only one down driving transistor is required in each column. Still further, only one clamping transistor is required in each column. Thus, the number of driving elements in the Y-electrode driving circuit is greatly in comparison with that of the prior art.

Figure 3:
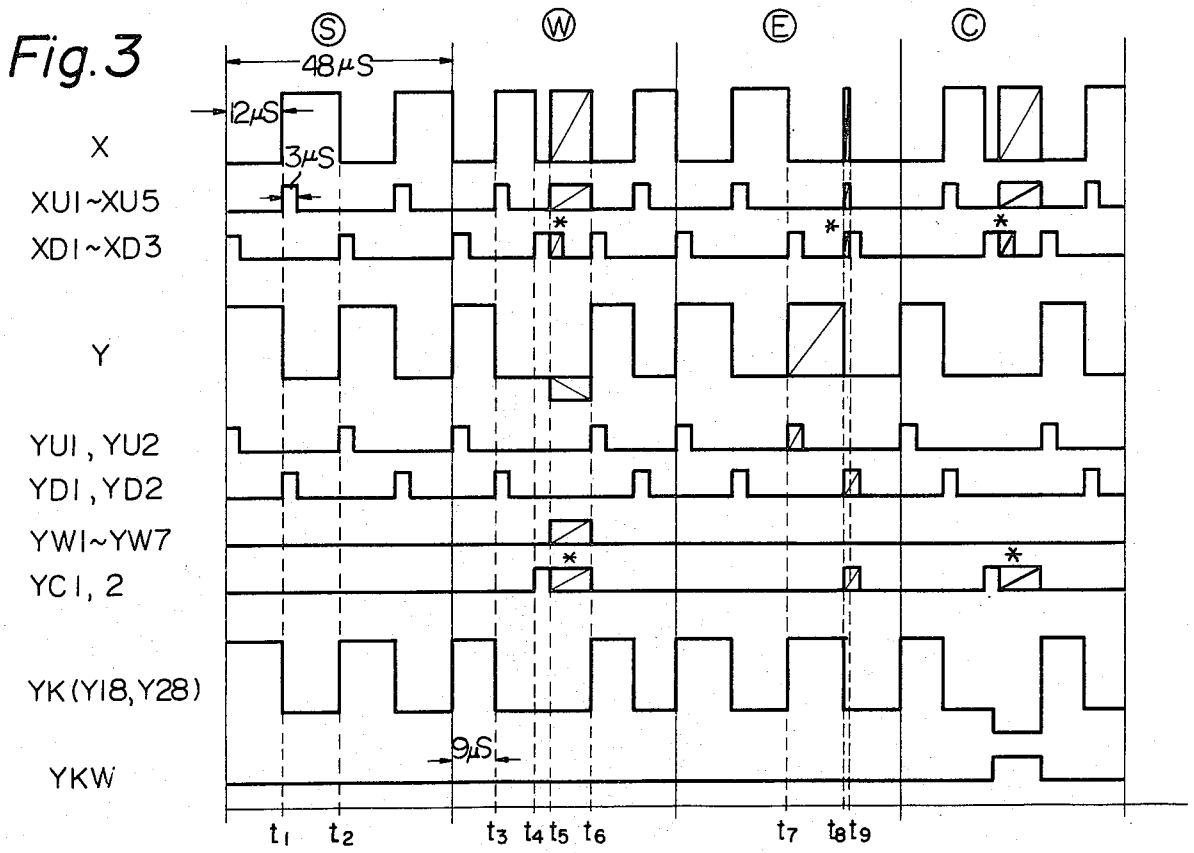
FIG. 3 is a time chart for explaining the operation of the circuits of FIGS. 1 and 2.

The operation of the X-electrode driving circuit and the Y-electrode driving circuit will now be explained with reference to the time chart illustrated in FIG. 3. It is assumed here that each switching pulse is to be applied to the base of a transistor through an appropriate capacitor (not shown). Also, the unit of the time slot of the discharge sustaining voltage, the write-in voltage or the erasing voltage is assumed to be 48 microseconds. In FIG. 3, S represents one time slot when the usually applied discharge sustaining voltage is applied; W represents one time slot when the write-in voltage is applied applied to a selected X electrode line; E represents one time slot of when the erasing voltage is applied to a selected X electrode line, and; C represents one time slot of when the write-in voltage is applied to the cursor electrode line Y18 (FIG. 2).

The usual discharge sustaining voltage is applied alternately to the X electrode lines and the Y electrode lines, as will now be explained. At the time $t_1$, a switching pulse is applied from a control circuit (not shown) to the bases of the up driving transistors XU1, XU2, . . . , XU5 and to the bases of the down driving transistors YD1 and YD2 to turn them on. Then, all of the X electrode lines X11, X12, . . . , X15, X21, X22, . . . , X25, X31, X32, . . . , X35 receive the voltage nearly equal to Vs through the resistors. Also, all of the Y electrode lines Y11, Y12, . . . , Y18, Y21, Y22, . . . , Y28 are grounded through the transistors YD1 and YD2. By the function of the capacitances (not shown) connected to the bases of the transistors XU1, XU2, . . . , XU5, when a switching pulse having a pulse width of three microseconds is applied to their bases. The X electrode lines receive the voltage Vs during more than twelve microseconds from the time $T_1$. Also, the Y electrode lines are grounded during more than twelve microseconds from the time $t_1$. At a time $t_2$ twelve microseconds after the time $t_1$, a switching pulse is applied to the bases of the down driving transistors XD1, XD2 and XD3, and to the bases of the up driving transistors YU1 and YU2 for producing the discharge sustaining voltage. Then, the voltage at all of the X electrode lines is turned from Vs volts to zero volts. Also, the voltage at all of the Y electrode lines is turned from zero volts to Vs volts. Thus, the voltage Vs is alternately applied to the X electrode lines and to the Y electrode lines so that the state of electrode lines, to which the write-in voltage is applied as hereinafter described, is maintained. Since the application of the voltage Vs to the Y electrode lines is effected at the same time when the X electrode lines are grounded, it is not necessary to clamp the negative voltage induced at the X electrode lines by applying the voltage to the Y electrode lines which are opposite to the X electrodes. Therefore, no clamping transistor is required in the circuit for driving the X electrodes.

The writing operation is as follows. Referring to the time slot W in FIG. 3, when writing is to be effected at the intersection between the first line in the first row of the X electrode lines and the first line in the first column of the Y electrode lines, the discharge sustaining voltage is applied to all of the X electrode lines, and all of the Y electrode lines are grounded at the time $t_3$ which is nine microseconds after the start of the write-in time slot W . Then, at the time $t_4$ which is nine microseconds after the time $t_3$, the down driving transistors XD1, XD2 and XD3 are turned on to ground all of the X electrode lines. It should be noted that, at the time $t_4$, the voltage Vs is not applied to the Y electrode lines because, shortly after the time $t_4$, a negative write-in voltage is to be applied to some of the Y electrode lines. Due to this fact, a negative voltage will be induced at the Y electrode lines when the voltage at the X electrode lines is lowered. Therefore, it is necessary to clamp the negative voltage. Thus, at the time $t_4$, a switching pulse is applied to the bases of the clamping transistors YC1 and YC2 so as to keep the voltage at the Y electrode lines to zero volts. At the time $t_5$ which is three microseconds after the time $t_4$, only the up driving transistor XU1 is selected to be turned on by applying a switching pulse having a pulse width of nine microseconds, and as well as only the down driving transistor XD1 is turned off. In FIG. 3, a slash line in a pulse designates the selected transistor, and in this case, the transistor XU1, which is turned on. The symbol * on a pulse, together with a slash line, designates the non-selected transistors, in this case the transistors XD2 and XD3, which are turned on. At the time $t_5$ also, only the write-in driving transistor YW1 is selected to be turned on by applying a switching pulse, i.e., write-in data, having a pulse width of nine microseconds, so that −Vw volts is applied to the electrode line Y11. At time, in order to avoid that the voltage −Vw being applied to the electrode line Y21 of the first line in the second column, the clamping transistor YC2 in the non selected column is turned on so that all of the Y electrode lines in the second column are grounded. Thus, at the time $t_5$, the voltage Vs is applied to the electrode line X11 only among all the X electrode lines and the voltage −Vw is applied to the electrode line Y11 only among all the Y electrode lines, so that the voltage at the intersection between the electrode lines X11 and Y11 becomes Vs+Vw which is larger than the minimum write-in voltage. As a result, writing is effected at the intersection.

When writing is to be effected at all the intersections on the first electrode line X11 in the first row, write-in data are applied to the write-in transistors YW1 through YW7, sequentially, so that the writing is effected by column scanning.

When writing is to be effected on all of the 5×7 dots in the first row and in the first column at the time $t_4$, all of the transistors XU1 through XU5 are turned on; the down driving transistor XD1 in the first row is turned off; the other down driving transistors XD2 and XD3 are turned on, and all of the write-in transistors YW1 through YW8 are turned on. Then, at the time $t_6$, the transistors XU1 through XU5 are turned off, and the transistors XD1 through XD3 are turned on. Thus, the required writing is performed.

It may be required that writing is to be effected on all the electrode lines included in the three rows and two columns. In this case, the required writing is performed by turning on all of the transistors XU1 through XU5, as well as by turning on all of the transistors YW1 through YW7, at the time $t_4$. In this case, writing is effected on the whole surface of the PDP.

The erasing operation will now be explained in conjunction with the time slot E in FIG. 3.

When erasing is to be effected at the intersection defined by the first electrode line X11 in the first row X10 and the first electrode line Y11 in the first column Y10, the transistors XD1 through XD3 are turned on so that all of the X electrode lines are grounded, and only the transistor YU1 corresponding to the first column Y10 is turned on while keeping the other transistor YU2 corresponding to the second column Y20 off, at the time $t_7$, resulting in that all of the Y electrode lines Y11 through Y18 in the first column are supplied with the discharge sustaining voltage Vs. Then, at the time $t_8$, a pulse having a fine pulse width of one microsecond is applied to the transistor XU1 corresponding to the first line in each row, and the down transistors XD2 and XD3 which do not correspond to the first row are turned on, resulting in that an erasing pulse having a fine width is applied to the electrode line X11 in the first line of the first row. Also, at the time $t_8$, the transistor YD1 is turned on so that all of the Y electrode lines in the first column are grounded, and, in order to compensate for the influence of the fine width pulse applied to the electrode line X11 returning to zero volts, the clamping transistor YC1 is turned on. Since the fine width pulse is applied to the first electrode line X11, charges are not sufficient for sustaining a discharge at the intersection between the electrode lines X11 and Y11. Thus, written data is erased at that intersection.

It is also possible to erase written data at any required intersection. Of course, erasing is possible for all intersections entirely or within any required portion determined by one row and one column. These erasing operations may easily be understood by those skilled in the art, and therefore, further explanation of the erasing operations is not described here.

In the time slot C , in FIG. 3, the writing operation for the cursor electrode lines Y18 and Y28 is illustrated. This writing operation is the same as that on the other Y electrode lines, and therefore, the explanation of this operation is not described here.

In the X-electrode driving circuit of FIG. 1, when a write-in pulse is to be applied to a selected electrode line, for example, to the electrode line X11, the transistor XU1 is turned on so that a current is conducted, not only through the electrode line X11 in the first row X10, but also, as a dummy current, through the first electrode lines X21 and X31 in the second row X20 and the third row X30, respectively. Also, when the write-in pulses are to be applied to all the electrode lines in one row for displaying one character, for example, to the electrode lines X11, X12, . . . , X15 in the first row X10, all of the up driving transistors XU1, XU2, . . . , XU5 are turned on so that the currents are conducted not only through the first row X10 but also, as dummy currents, through the second row X20 and the third row X30. Therefore, the dummy current will increase when the number of X rows increases. These dummy currents cause an unreasonable large load on the up driving transistors XU1, XU2, . . . , or XU5, resulting in unreasonably high power being used in the circuit of FIG. 1.

Figure 4:
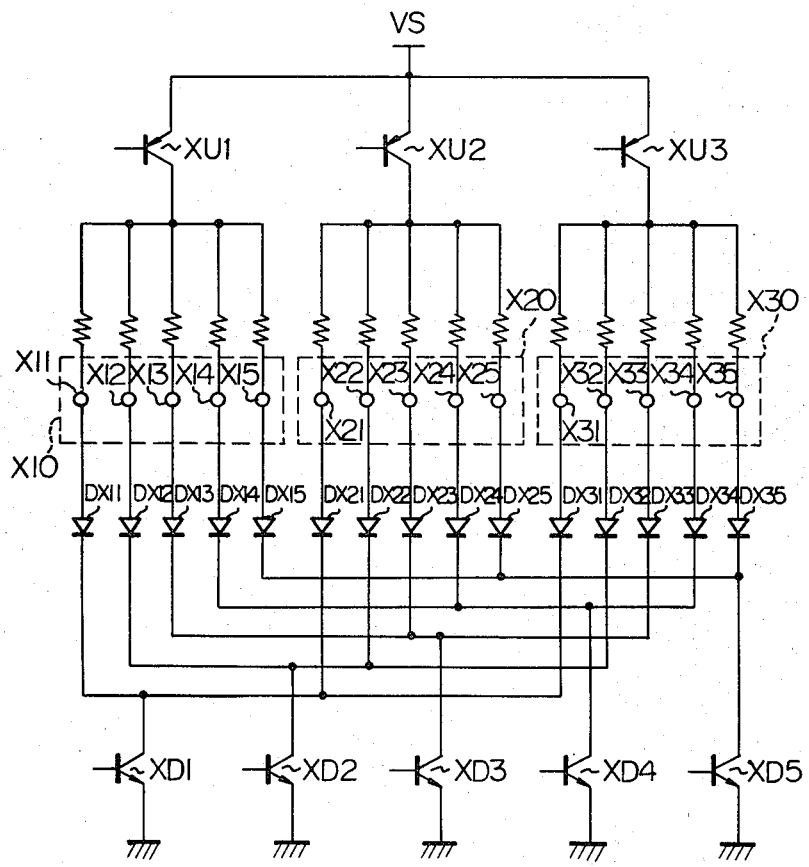
FIG. 4 is a circuit diagram illustrating a main portion of an X-electrode driver in a driving circuit, according to another embodiment of the present invention.

FIG. 4 is a circuit diagram illustrating an X-electrode driving circuit, according to another embodiment of the present invention, in which like reference characters designate the same or similar parts of the circuit of FIG. 1. In FIG. 4, the connecting positions of the up driving transistors and down driving transistors are reversed compared with the circuit of FIG. 1. That is, in place of the five up driving transistors XU1, XU2, . . . , and XU5 as in the circuit of FIG. 1, three up-driving transistors XU1, XU2 and XU3 are connected through resistors to the X electrode lines X11, X12, . . . , X15, X21, X22, . . . , X25, X31, X32, . . . , X35. Also, instead of three down driving transistors XD1, XD2 and XD3 as in the circuit of FIG. 1, five down driving transistors XD1, XD2, . . . , XD5 are connected through diodes to the first electrode line through the fifth electrode line in each row, respectively.

In operation, when a write-in pulse is to be applied to a desired one electrode line, for example, to the first electrode line X11 in the first row X10, the up driving transistor XU1 is turned on so that dummy currents flow through the other four lines in the first row. No dummy current will flow through the other four rows. Therefore, if the number of rows is more than the number of electrode lines included in one row, the circuit of this second embodiment will consume a smaller amount of power than the circuit of FIG. 1. In addition, when the write-in pulses are to be applied to all the electrode lines in one row for displaying one character, no dummy current is conducted in the circuit of FIG. 4.

Figure 5:
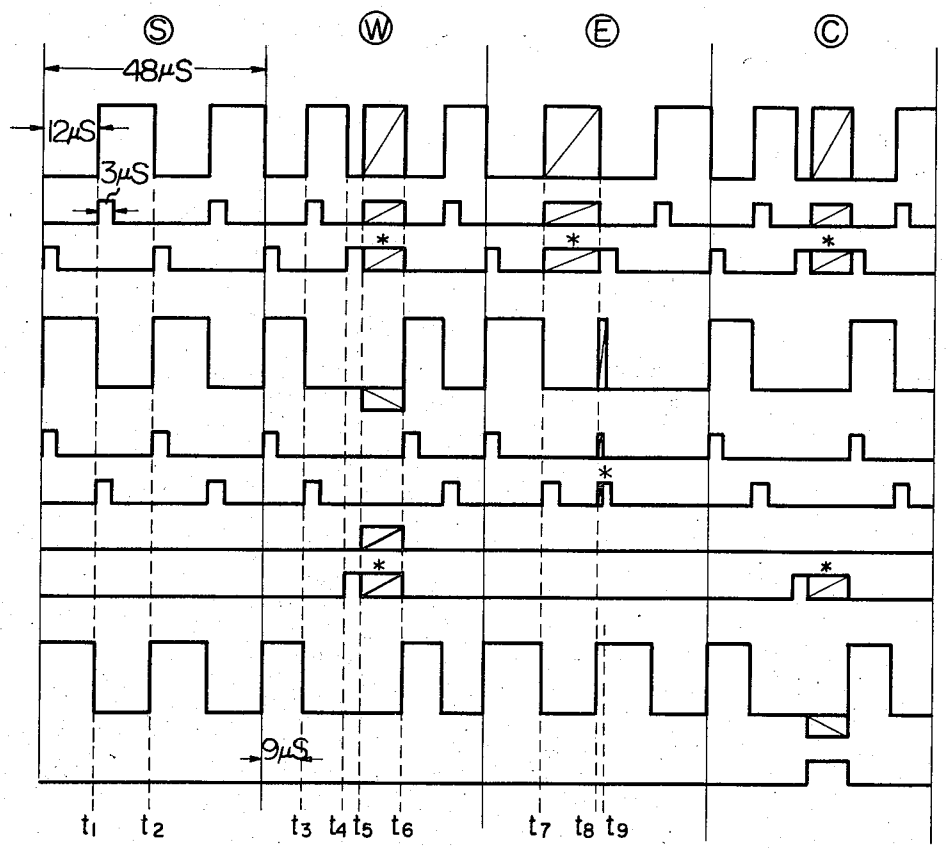
FIG. 5 is a time chart for explaining the operation of the circuit of FIG. 4.

The more detailed operation of the circuit of FIG. 4 can easily be understood to those skilled in the art with reference to FIG. 5.

In the foregoing embodiments, although the driving circuit of the PDP is comprised of three rows of X electrode lines and two columns of Y electrode lines, each row comprising five electrode lines and each column comprising eight electrode lines including the cursor electrode, for displaying a maximum of six characters with cursor indications, and for displaying each character including a cursor by 5×8 dots, the present invention is not restricted to these embodiments. That is, by increasing or decreasing the number of electrode lines in each row or in each column, a character or a cursor may be displayed by any desired number of dots. Also, by increasing or decreasing the number of rows or columns, any desired number of characters may be displayed.

From the foregoing description, since the up driving circuit is commonly used both for applying the discharge sustaining voltage and for applying the write-in voltage in the X-electrode driving circuit, it will be understood that the number of the driving elements is greatly decreased in comparison with the prior art. Also, since the number of write-in drivers in the Y-electrode driving circuit is the same as the number of Y electrode lines included in one column, and since only one up driving transistor for producing the discharge sustaining voltage is provided for each column, the number of the driving elements in the Y-electrode driving circuit is greatly decreased in comparison with the prior art. Further, by applying the discharge sustaining voltage to the X-electrode lines when no discharge sustaining voltage is applied to the Y electrode lines, a clamping circuit is not required in the X-electrode driving circuit. Thus, according to the present invention, the cost of the driving circuit for a gas discharge panel is greatly decreased in comparison with the prior art.

In addition, according to the present invention, since writing or erasing can be effected on each dot, on each row or column, or on the entire surface, the driving circuit can be adapted not only to a character display but also to a graphic display.

We claim:

1. A gas discharge panel device, comprising a plurality of rows of X electrodes and a plurality of columns of Y electrodes, said rows and columns being arranged in a matrix, and a driving circuit including an X-electrode driver and a Y-electrode driver for controlling the display by selectively applying a discharge sustaining voltage and a write-in voltage to said X and Y electrodes, and said X electrode driver comprising a first up drive circuit commonly used for selectively applying said discharge sustaining voltage to said X electrodes for both writing and sustaining information in said device, and a first down drive circuit for selectively grounding said X electrodes during a time when said sustain voltage is not being applied to said Y electrodes.

2. The device of claim 1, said Y-electrode driver comprising a second up drive circuit for selectively applying said discharge sustaining voltage to said Y electrodes, a second down drive circuit for selectively grounding said Y electrodes during a time when said discharge sustaining voltage is not applied to said Y electrodes, a write-in driver for selectively applying said write-in voltage to said Y electrodes, and a clamping circuit for selectively grounding said Y electrodes.

3. The device of claim 1 or 2, wherein each of said rows of the X electrodes comprises a predetermined number of X electrode lines, and said first up drive circuit comprises a plurality of first up driving semiconductor elements, the number of said first up driving semiconductor elements being equal to said predetermined number, each of said first up driving semiconductor elements being commonly connected to a respective one of said X electrode lines in each of said rows, so as to commonly drive the respective X electrode line in each said row.

4. The device of claim 3, wherein said first down drive circuit comprises a plurality of first down driving semiconductor elements, the number of said first down driving semiconductor elements being equal to the number of said rows of the X electrodes, each of said first down driving semiconductor elements being commonly connected to all of the electrode lines included in a respective one of said rows, so as to commonly drive all the commonly connected X electrode lines of the respective row.

5. The device of claim 3, wherein said sustain and write-in voltages applied to said X electrodes and said sustain voltage applied to said Y electrodes are equal to a first predetermined voltage level.

6. The device of claim 5, wherein said first predetermined voltage level is selectively applied by selected ones of said X-electrode and Y-electrode driver circuits, in combination with the selective operation of said clamping circuit, to selectively erase according to selected ones of said X- and Y-electrodes.

7. The device of claim 2, wherein each of said columns of the Y electrodes comprises a predetermined number of Y electrode lines, and said second up drive circuit comprises a plurality of second up driving semiconductor elements, the number of said second up driving semiconductor elements being equal to the number of said columns of the Y electrodes, each of said second up driving semiconductor elements being commonly connected to all of the Y electrode lines in a corresponding one of said columns, so as to commonly drive all the Y electrode lines included in said column.

8. The device of claim 7, wherein said second down drive circuit comprises a plurality of second down driving semiconductor elements, the number of said second down driving semiconductor elements being equal to the number of said columns of the Y electrodes, each of said said second down driving semiconductor elements being commonly connected to all of said Y electrode lines in a corresponding one of said columns, so as to commonly drive all the Y electrode lines included in the respective column.

9. The device of claim 7, wherein said write-in driver comprises a plurality of write-in semiconductor elements, the number of said write-in semiconductor elements being equal to the number of said Y electrode lines in each said column, each of said write-in semiconductor elements being connected to a respective one of said Y electrode lines in each of said columns so as to commonly drive the respective Y electrode line in each of said columns.

10. The device of claim 7, 8 or 9, wherein said clamping circuit comprises a plurality of clamping semiconductor elements, the number of said clamping semiconductor elements being equal to the number of said columns of the Y electrodes, each of said clamping semiconductor elements being commonly connected to all of said Y electrode lines in the corresponding column, so as to commonly drive all the Y electrode lines of the corresponding column.

11. The device of claim 10, wherein said sustain and write-in voltages applied to said X electrodes and said sustain voltage applied to said Y electrodes are equal to a first predetermined voltage level.

12. The device of claim 11, wherein said first predetermined voltage level is selectively applied by selected ones of said X-electrode and Y-electrode driver circuits, in combination with the selective operation of said clamping circuit, to selectively erase according to selected ones of said X- and Y-electrodes.

13. The device of claim 8, wherein said write-in driver comprises a plurality of write-in semiconductor elements, the number of said write-in semiconductor elements being equal to the number of said Y electrode lines in each of said column, each of said write-in semiconductor elements being connected to a respective one of said Y electrode lines in each of said columns, so as to commonly drive the respective Y electrode lines in all of said columns.

14. The device of claim 1 or 2, wherein each of said rows of the X electrodes is comprised of a predetermined number of X electrode lines, and said first up driving circuit comprises a plurality of first up driving semiconductor elements, the number of said first up driving semiconductor elements being equal to the number of said rows, each of said first up driving semiconductor elements being connected to all of the X electrode lines in a respective one of said rows, so as to commonly drive all the X electrode lines of the respective row.

15. The device of claim 14, wherein said first down drive circuit comprises a plurality of first down driving semiconductor elements, the number of said first down driving semiconductor elements being equal to the number of said X electrode lines in each said row, each of said first down driving semiconductor elements being commonly connected to a respective X electrode line in each of said rows, so as to commonly drive the commonly connected X electrode line in all of said rows.

16. A gas discharge panel device, comprising a gas discharge panel provided with a plurality of rows of X electrodes and a plurality of columns of Y electrodes, said rows and columns being arranged in a matrix, an X-electrode driver for driving said X electrodes, said X-electrode driver comprising a first up drive circuit commonly used for applying a predetermined voltage as a discharge sustaining voltage and a write-in voltage to said X electrodes, and a first down drive circuit for grounding said X electrodes, and a Y-electrode driver for driving said Y electrodes, said Y-electrode driver comprising a second up drive circuit for applying a discharge sustaining voltage to said Y electrodes, a second down drive circuit for selectively grounding said Y electrodes when said discharge sustaining voltage is not applied to said Y electrodes, a write-in driver for applying a write-in voltage to said Y electrodes, and a clamping circuit for selectively grounding said Y electrodes when said write-in voltage is not applied to said Y electrodes, wherein, when writing is to be effected, said first and second up drive circuits drive selected ones of said X electrodes and said Y electrodes in selected ones of said rows and columns, respectively, and said first and second down drive circuits drive the non-selected rows and columns to ground the electrodes in said non-selected rows and columns.

17. The device of claim 16, comprising means for making the time when said X electrodes are grounded by said first down drive circuit to be simultaneous with the time when said second up drive circuit applies a discharge sustaining voltage to the Y electrodes, wherein no clamping circuit is required in said X-electrode driver.

18. The device of claim 2, 7, 8, 9, 16 or 17, wherein said sustain and write-in voltages applied to said X electrodes and said sustain voltage applied to said Y electrodes are equal to a first predetermined voltage level.

19. The device of claim 18, wherein said first predetermined voltage level is selectively applied by selected ones of said X-electrode and Y-electrode driver circuits, in combination with the selective operation of said clamping circuit, to selectively erase according to selected ones of said X- and Y-electrodes.

20. A gas discharge panel device for displaying information in the form of discharge spots comprising a plurality of rows of X electrodes, each said row having a predetermined number of said X electrodes, X drive means for switching all of said X electrodes between a first potential and ground for sustaining said information, and for switching at least one selected one of said X electrodes between said first potential and ground for writing and erasing said information, said X drive means having a number of transistors equal to the sum of the number of said plurality of rows plus said predetermined number of X electrodes in each said row, a plurality of columns of Y electrodes, each said column having a predetermined number of said Y electrodes, and each said Y electrode crossing each said X electrode to form an array of crossing points at which said discharge spots may be produced, and Y drive means for switching all of said Y electrodes between said first potential and ground for sustaining said information, for switching a first selected plurality of said Y electrodes between said first potential and ground for erasing said information, and for switching a second selected plurality of said Y electrodes between a second potential and ground for writing said information, said second potential having polarity opposite that of said first potential, said Y drive means having a number of transistors equal to the sum of three times the number of said first selected plurality of Y electrodes plus the number of said second selected plurality of Y electrodes, wherein the sustaining, writing and erasing of information into said crossing points of said array may be controlled by said transistors.

21. The device of claim 20, said first selected plurality of Y electrodes being equal in number to said predetermined number of said Y electrodes in each said column, and said second plurality of Y electrodes being equal in number to said plurality of columns.

22. The device of claim 21 comprising said transistors of said Y drive means including, for each said column of Y electrodes, a transistor connected between ground and a first conducting line commonly connected to all the Y electrodes of the column, an up driving transistor connected between said first potential and said first conducting line, and a down driving transistor connected between ground and a second conducting line commonly connected to all the Y electrodes of the column, said Y drive means further including, for each said column, a first diode connected between the respective first conducting line and the respective clamping transistor to prevent the first conducting line from going to a negative potential when the clamping transistor is on, a plurality of second diodes connected between the first conducting line and each of said Y electrodes of the column for applying said first potential to the Y electrodes of the column when the respective up driving transistor is turned on, and a plurality of third diodes connected between the second conducting line and the Y electrodes of the column for grounding all the Y electrodes of the column when the respective down driving transistor is turned on, and a write transistor connected to provide said second potential in common to the same respective Y electrode in each of said columns.

23. The device of claim 22, said transistors of said Y drive means including, for each said column, a clamping transistor commonly connected to prevent the Y electrodes of the column from going to a potential with polarity the same as that of said second potential when one of said X electrodes is switched from said first potential to ground, an up driving transistor connected to switch all the Y electrodes of the column to said first potential, and a down driving transistor connected to switch all the Y electrodes of the column to ground.

24. The device of claim 20, 21, 22 or 23, said transistor of said X drive means including an up driving transistor commonly connected to the same respective X electrode in all of said rows, and a down driving transistor for each said row, each commonly connected to all the X electrodes in the respective row.

25. The device of claim 20, 21, 22 or 23, said transistors of said X drive means including an up driving transistor for each said row, each commonly connected to all the X electrodes of the respective row, and a down driving transistor commonly connected to the same respective X electrode in all of said rows.

26. The device of claim 24, wherein said X and Y drive means sustain said discharge spots by controlling the switching of said transistors so that said first potential is alternately applied to said X and Y electrodes for sustaining any information written at each said crossing point.

27. The device of claim 25, wherein said X and Y drive means sustain said discharge spots by controlling the switching of said transistors so that said first potential is alternately applied to said X and Y electrodes for sustaining any information written at each said crossing point.

28. The device of claim 24, wherein, for the writing of said information, said X and Y drive means apply said first potential to at least one selected one of said X electrodes while applying said second potential to at least one plurality of one of said first and second selected pluralities of Y electrodes, while clamping, with the respective ones of said transistors, the other pluralities of said one of said first and second selected pluralities of Y electrodes.

29. The device of claim 25, wherein, for the writing of said information, said X and Y drive means apply said first potential to at least one selected one of said X electrodes while applying said second potential to at least one plurality of one of said first and second selected pluralities of Y electrodes, while clamping, with the respective ones of said transistors, the other pluralities of said one of said first and second selected pluralities of Y electrodes.

* * * * *

UNITED STATES PATENT AND TRADEMARK OFFICE

CERTIFICATE OF CORRECTION

PATENT NO. : 4,386,297

DATED : 31 May 1983

INVENTOR(S) : Itoh et al

It is certified that error appears in the above-identified patent and that said Letters Patent is hereby corrected as shown below:

Col. 3, line 22, "inventin" should be --invention--.

Col. 4, line 6, "rox" should be --row--;
line 9, "rox" should be --row--;
line 33, "togethe" should be --together--;
line 34, "vw" should be --$V_w$--;
line 43, "DYl" should be --DYll--;
line 63, "vs" should be --$V_s$--;
line 66, "aND" should be --and--.

Col. 5, line 61, "$T_1$" should be --$t_1$--.

Col. 10, claim 8, line 29, delete second occurrence of "said".

Signed and Sealed this

*Eleventh* Day of *October 1983*

[SEAL]

*Attest:*

GERALD J. MOSSINGHOFF

*Attesting Officer*

*Commissioner of Patents and Trademarks*